US009652970B2

(12) United States Patent
Kargbo et al.

(10) Patent No.: US 9,652,970 B2
(45) Date of Patent: May 16, 2017

(54) HYGIENE ALERT SYSTEM

(71) Applicants: Yassah Kargbo, Potomac, MD (US); Toafiq Raymond, Sr., Potomac, MD (US)

(72) Inventors: Yassah Kargbo, Potomac, MD (US); Toafiq Raymond, Sr., Potomac, MD (US)

( * ) Notice: Subject to any disclaimer, the term of this patent is extended or adjusted under 35 U.S.C. 154(b) by 0 days.

(21) Appl. No.: 14/840,218

(22) Filed: Aug. 31, 2015

(65) Prior Publication Data

US 2017/0061775 A1 Mar. 2, 2017

(51) Int. Cl.
*G08B 21/00* (2006.01)
*G08B 21/24* (2006.01)

(52) U.S. Cl.
CPC ..... *G08B 21/245* (2013.01)

(58) Field of Classification Search
CPC ..... G08B 21/245; E03D 1/00
USPC ..... 340/618, 573.1, 691.1, 309.16; 4/300, 4/449
See application file for complete search history.

(56) References Cited

U.S. PATENT DOCUMENTS

| | | | | |
|---|---|---|---|---|
| D317,135 | S | 5/1991 | Novack | |
| 6,028,520 | A * | 2/2000 | Maehre | A47K 13/24 340/522 |
| 6,417,773 | B1 * | 7/2002 | Vlahos | A47K 17/00 340/522 |
| 8,514,067 | B2 | 8/2013 | Hyde et al. | |
| 8,648,724 | B2 * | 2/2014 | Forsberg | G08B 3/10 340/5.61 |
| 8,941,503 | B1 * | 1/2015 | Hobson | E03D 1/00 340/604 |
| 2012/0060270 | A1 * | 3/2012 | Ihlefeld | E03D 1/01 4/300 |
| 2012/0062382 | A1 | 3/2012 | Taneff | |

* cited by examiner

*Primary Examiner* — Phung Nguyen

(57) ABSTRACT

A hygiene alert system includes a toilet that has a tank and the tank may contain a fluid. The tank has a lid and the lid has a top surface and a bottom surface. An alert is coupled to the tank such that the alert may detect the fluid in the tank. The alert issues a verbal reminder and a visual reminder when the alert detects the fluid has drained from the tank. Thus, the alert communicates a reminder for personal hygiene.

5 Claims, 3 Drawing Sheets

HYGIENE ALERT SYSTEM

BACKGROUND OF THE DISCLOSURE

Field of the Disclosure

The disclosure relates to alert devices and more particularly pertains to a new alert device for reminder a user to wash the user's hands after utilizing a toilet.

SUMMARY OF THE DISCLOSURE

An embodiment of the disclosure meets the needs presented above by generally comprising a toilet that has a tank and the tank may contain a fluid. The tank has a lid and the lid has a top surface and a bottom surface. An alert is coupled to the tank such that the alert may detect the fluid in the tank. The alert issues a verbal reminder and a visual reminder when the alert detects the fluid has drained from the tank. Thus, the alert communicates a reminder for personal hygiene.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
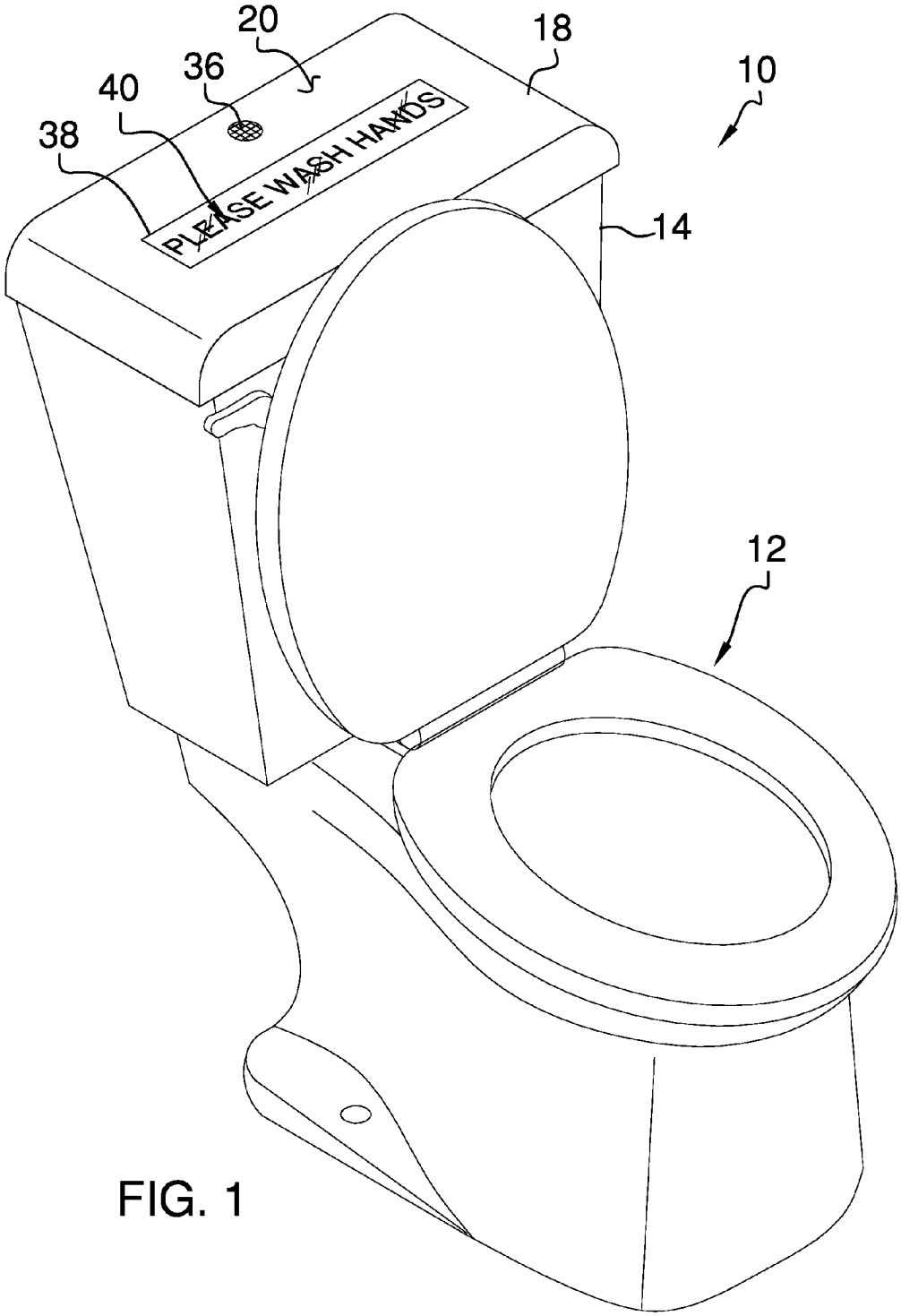
FIG. 1 is a front perspective view of a hygiene alert system according to an embodiment of the disclosure.
Figure 2:
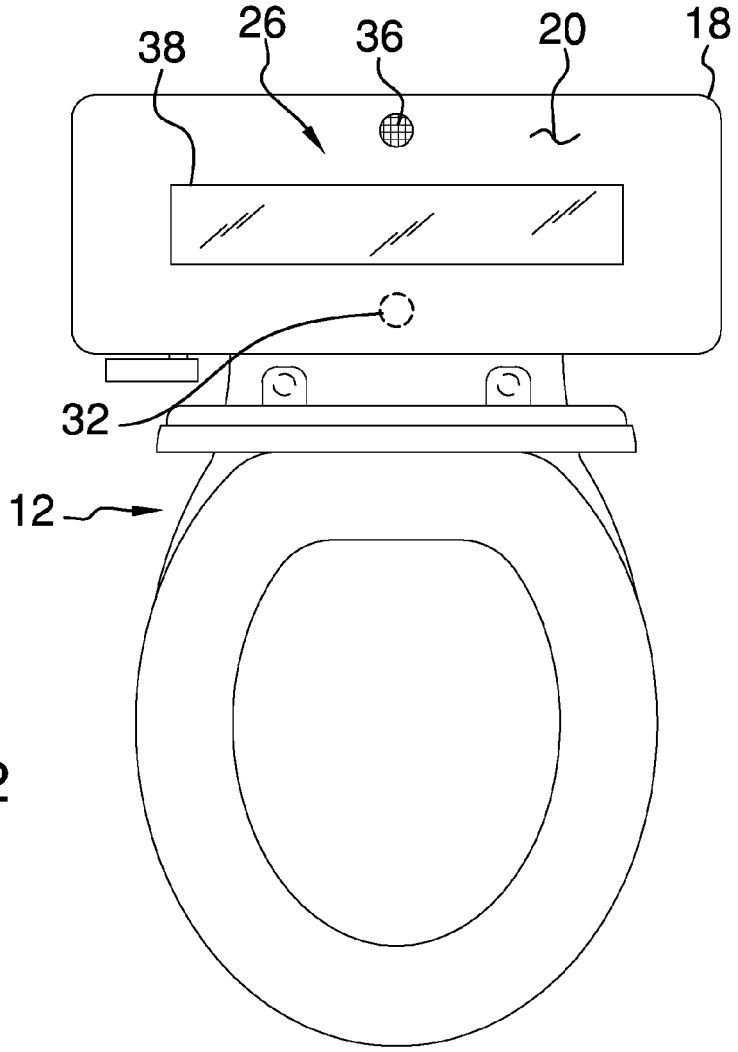
FIG. 2 is a top view of an embodiment of the disclosure.
Figure 3:
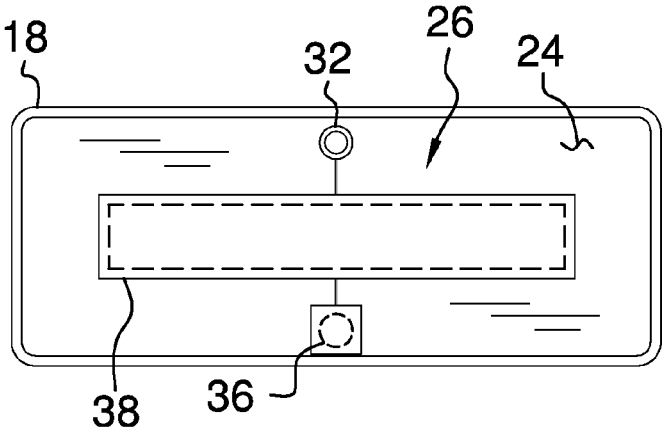
FIG. 3 is a bottom view of an embodiment of the disclosure.
Figure 4:
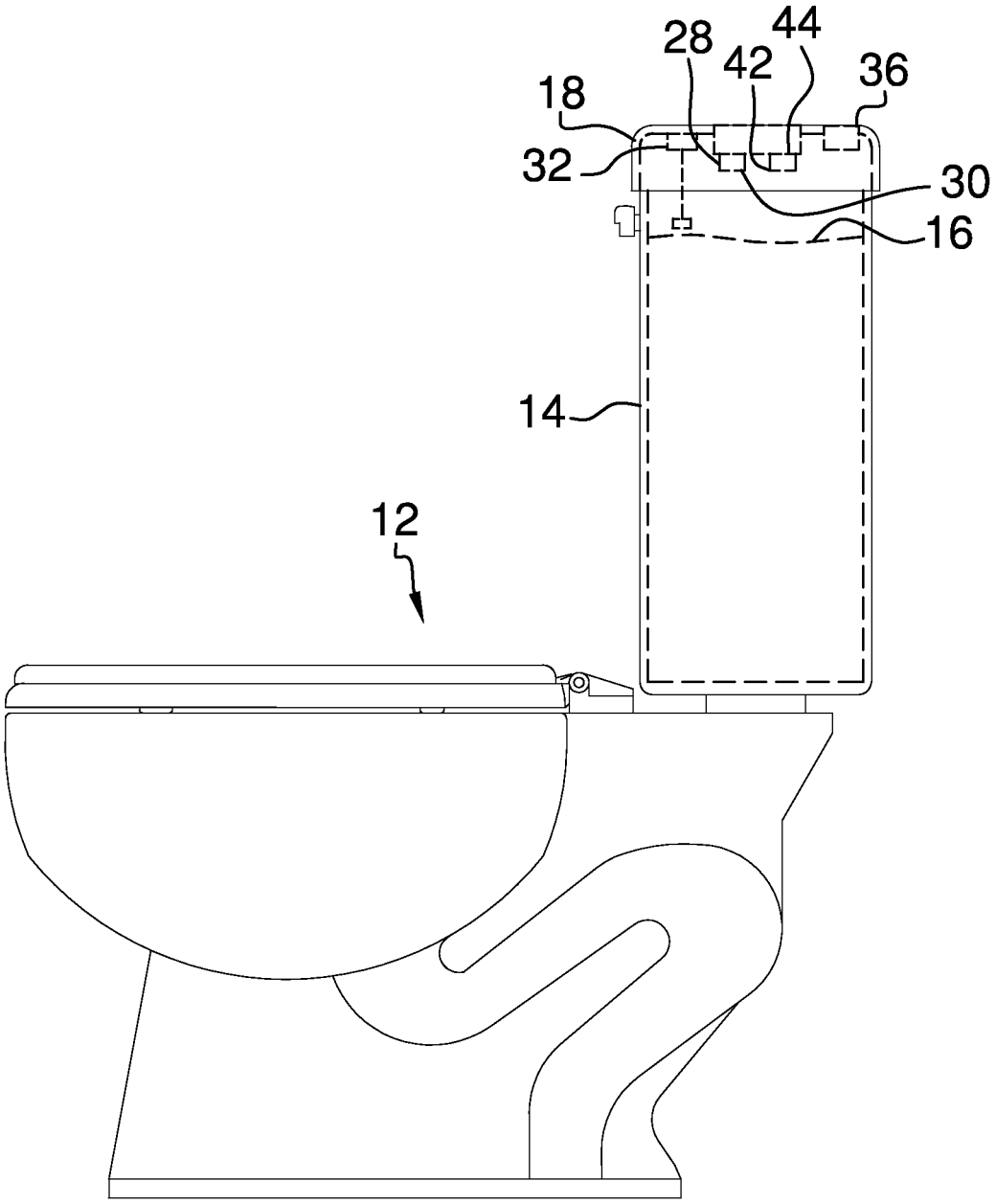
FIG. 4 is a left side phantom view of an embodiment of the disclosure.

With reference now to the drawings, and in particular to FIGS. 1 through 4 thereof, a new alert device embodying the principles and concepts of an embodiment of the disclosure and generally designated by the reference numeral 10 will be described.

As best illustrated in FIGS. 1 through 4, the hygiene alert system 10 generally comprises a toilet 12. The toilet 12 has a tank 14 and the tank 14 may contain a fluid 16. The tank 14 has a lid 18 and the lid 18 has a top surface 20 and a bottom surface 24. The toilet 12 may comprise a plumbing fixture or the like and the fluid 16 may comprise water.

An alert 26 is coupled to the tank 14 such that the alert 26 detects the fluid 16 in the tank 14. The alert 26 issues a verbal reminder and a visual reminder when the alert 26 detects the fluid 16 has been drained from the tank 14. Thus, the alert 26 communicates a reminder for personal hygiene when the toilet 12 is flushed. The alert 26 comprises a processor 28 that is coupled to the lid 18. The processor 28 includes an electronic memory 30 and the electronic memory 30 stores an audio file. The audio file comprises a verbal reminder for personal hygiene and the verbal reminder for personal hygiene may include the words "Please wash hands".

A fluid sensor 32 is coupled to the bottom surface 24 of the lid 18 and the fluid sensor 32 is electrically coupled to the processor 28. The fluid sensor 32 extends downwarldy into the tank 14 such that the fluid sensor 32 detects the fluid 16 in the tank 14. The processor 28 generates an alarm sequence when the fluid sensor 32 no longer detects the fluid 16 in the tank 14 corresponding to the toilet 12 being flushed. The fluid sensor 32 may comprise an electronic fluid sensor or the like. Additionally, the fluid sensor 32 may comprise a mechanical fluid sensor or the like.

A speaker 36 is coupled to the top surface 20 of the lid 18 and the speaker 36 is electrically coupled to the processor 28. The speaker 36 emits the verbal alert for personal hygiene when the processor 28 generates the alarm sequence. Thus, the speaker 36 may issue the verbal reminder for personal hygiene. The speaker 36 may be centrally positioned on the lid 18.

A display 38 is coupled to the top surface 20 of the lid 18 such that the display 38 may be observed and the display 38 is electrically coupled to the processor 28. The display 38 displays indicia 40 when the processor 28 generates the alarm sequence. Thus, the display 38 may issue a visual reminder for personal hygiene. The indicia 40 may comprise the words "Please wash hands" and the display 38 may comprise an LED or the like. A power supply 42 is coupled to the lid 18. The power supply 42 is electrically coupled to the processor 28 and the power supply 42 comprises at least one battery 44.

In use, the toilet 12 is utilized for the purposed of urination or defecation. The speaker 36 emits the verbal reminder for personal hygiene when the toilet 12 is flushed. The display 38 displays the visual reminder for personal hygiene when the toilet 12 is flushed. The speaker 36 and the display 38 remind a user to wash the user's hands after the toilet 12 is utilized.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A hygiene alert system comprising:

a toilet having a tank, said tank being configured to contain a fluid, said tank having a lid, said lid having a top surface and a bottom surface;

an alert being coupled to said tank wherein said alert is configured to detect the fluid in said tank, said alert being configured to issue a verbal reminder and a visual reminder when said alert detects the fluid has drained from said tank thereby facilitating said alert to communicate a reminder for personal hygiene, said alert comprising a processor being coupled to said lid, said processor including an electronic memory, said electronic memory storing an audio file, said audio file comprising the verbal reminder for personal hygiene; and a display being coupled to and flush with said top surface of said lid wherein said display is configured to be observed, said display being electrically coupled to said processor, said display displaying indicia when said processor generates an alarm sequence wherein said display is configured to issue the visual reminder for personal hygiene.

2. The system according to claim 1, further comprising a fluid sensor being coupled to said bottom surface of said lid, said fluid sensor being electrically coupled to said processor, said fluid sensor extending downwardly into said tank wherein said fluid sensor is configured to detect the fluid in said tank, said processor generating the alarm sequence when said fluid sensor no longer detects the fluid in said tank corresponding to said toilet being flushed.

3. The system according to claim 1, further comprising a speaker being coupled to said top surface of said lid, said speaker being electrically coupled to said processor, said speaker emitting said verbal reminder for personal hygiene when said processor generates said alarm sequence.

4. The system according to claim 1, further comprising a power supply being coupled to said lid, said power supply being electrically coupled to said processor, said power supply comprising at least one battery.

5. A hygiene alert system comprising:

a toilet having a tank, said tank being configured to contain a fluid, said tank having a lid, said lid having a top surface and a bottom surface; and an alert being coupled to said tank wherein said alert is configured to detect the fluid in said tank, said alert being configured to issue a verbal reminder and a visual reminder when said alert detects the fluid has drained from said tank thereby facilitating said alert to communicate a reminder for personal hygiene, said alert comprising:

a processor being coupled to said lid, said processor including an electronic memory, said electronic memory storing an audio file, said audio file comprising the verbal reminder for personal hygiene, a fluid sensor being coupled to said bottom surface of said lid, said fluid sensor being electrically coupled to said processor, said fluid sensor extending downwardly into said tank wherein said sensor is configured to detect the fluid in said tank, said processor generating an alarm sequence when said fluid sensor no longer detects the fluid in said tank corresponding to said toilet being flushed, a speaker being coupled to said top surface of said lid, said speaker being electrically coupled to said processor, said speaker emitting said verbal alert for personal hygiene when said processor generates said alarm sequence wherein said speaker is configured to issue the verbal reminder for personal hygiene, a display being coupled to and flush with said top surface of said lid wherein said display is configured to be observed, said display being electrically coupled to said processor, said display displaying indicia when said processor generates said alarm sequence wherein said display is configured to issue the visual reminder for personal hygiene, and a power supply being coupled to said lid, said power supply being electrically coupled to said processor, said power supply comprising at least one battery.

* * * * *